US007624720B1

(12) United States Patent
Dokas et al.

(10) Patent No.: US 7,624,720 B1
(45) Date of Patent: Dec. 1, 2009

(54) VARIABLE SET POINT FUEL PRESSURE REGULATOR

(75) Inventors: David M. Dokas, Ann Arbor, MI (US); Robert Joseph Pyle, Canton, MI (US); Dequan Yu, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/184,941

(22) Filed: Aug. 1, 2008

(51) Int. Cl.
*F02M 59/36* (2006.01)
*F02M 59/38* (2006.01)

(52) U.S. Cl. ..... 123/458; 123/457

(58) Field of Classification Search ..... 123/458, 123/457, 511, 514, 506, 446
See application file for complete search history.

(56) References Cited

U.S. PATENT DOCUMENTS 4,112,888 A * 9/1978 Okabayashi ..... 123/406.7
4,310,016 A * 1/1982 Aubel ..... 137/493.8
4,711,209 A * 12/1987 Henkel ..... 123/300
4,782,808 A 11/1988 Bostick et al.
4,957,084 A * 9/1990 Kramer et al. ..... 123/447
5,458,104 A 10/1995 Tuckey
5,529,035 A 6/1996 Hunt et al.
5,537,980 A 7/1996 Yamamoto
5,803,369 A * 9/1998 Toyao et al. ..... 239/533.8
5,967,120 A 10/1999 Blanton et al.
6,073,613 A 6/2000 Warner
6,209,525 B1 * 4/2001 Konishi et al. ..... 123/467
6,279,545 B1 * 8/2001 Frank et al. ..... 123/514
7,278,402 B2 10/2007 Schelhas

FOREIGN PATENT DOCUMENTS

FR 2637021 9/1988

* cited by examiner

*Primary Examiner*—Mahmoud Gimie
(74) *Attorney, Agent, or Firm*—Allan J. Lippa; Alleman Hall McCoy Russell & Tuttle LLP

(57) ABSTRACT

A fuel pressure regulator is provided. The fuel pressure regulator includes a body forming an inlet and an outlet, a seal element positioned intermediate the inlet and the outlet, an armature positioned to apply force to the seal element, and a solenoid coiled around the armature, wherein excitation of the solenoid causes a change in at least one of a position of the armature relative to the seal element and a force applied by the armature to the seal element to vary a regulated fuel pressure set-point at which fuel flows through the outlet.

18 Claims, 3 Drawing Sheets

VARIABLE SET POINT FUEL PRESSURE REGULATOR

BACKGROUND AND SUMMARY

Many internal combustion engines utilize Gasoline Direct Injection (GDI) to increase the power efficiency and range over which the fuel can be delivered to the cylinder. One potential issue with GDI is that under lower fuel pressures the fuel may not sufficiently mix with the air in the cylinder. Insufficient mixing may decrease engine power and efficiency, and increase emissions, at least under some conditions. For example, during cold engine starts, and before the catalytic converter is activated, insufficient mixing as a result of lower fuel pressure may exacerbate cold start emissions.

In one example, a fuel delivery system includes a lower pressure fuel pump and a high pressure fuel pump in combination to achieve a higher fuel pressure. However, at startup the two-pump system may require a longer duration to pump fuel at the higher fuel pressure, which may result in engine miss-starts. Moreover, the consistently higher fuel pressure may cause increased wear on components of the fuel delivery system.

One approach to provide temporarily increased fuel pressure during startup may include utilizing a fuel pressure regulator comprising: a body forming an inlet and an outlet; a seal element positioned intermediate the inlet and the outlet; an armature positioned to apply force to the seal element; and a solenoid coiled around the armature, with excitation of the solenoid causing a change in at least one of a position of the armature relative to the seal element and a force applied by the armature to the seal element to vary a regulated fuel pressure set-point at which fuel flows through the outlet.

By integrating a solenoid into the design of the regulator, the force applied to the seal element of the fuel pressure regulator may be adjusted on demand as operating conditions vary to adjust a fuel pressure set-point. In this way, fuel pressure may be temporarily increased at startup for improved combustion. Moreover, by utilizing the fuel pressure regulator, the fuel pressure set-point may be decreased after startup to reduce wear on fuel delivery system components. In this way, the operational lifetime of the fuel delivery system may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION

DETAILED DESCRIPTION

Figure 1:
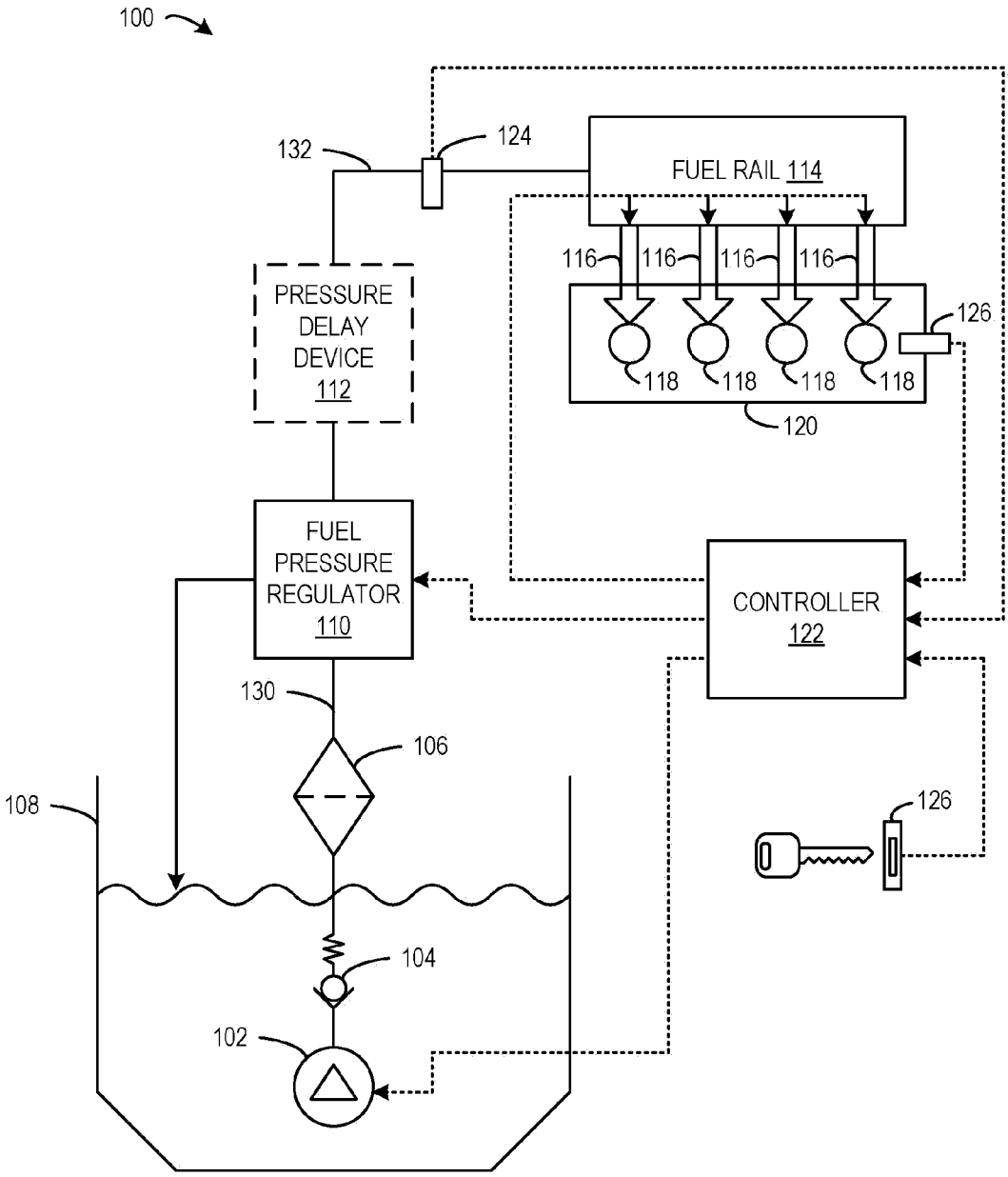
FIG. 1 shows a schematic diagram of an example fuel delivery system.

FIG. 1 shows a schematic depiction of a fuel delivery system 100 for an internal combustion engine that utilizes gasoline direct injection (GDI) for use in a vehicle. Fuel delivery system 100 includes fuel pump 102 to pump liquid fuel from fuel tank 108. In this embodiment, fuel pump 102 is an electronically controlled variable speed lift pump. In some cases, fuel pump 102 may only operate at a limited number of speeds. It will be appreciated that the fuel tank may contain any fuel suitable for an internal combustion engine such as gasoline, methanol, ethanol, or any combination thereof.

Fuel pump 102 is fluidly coupled to check valve 104 to facilitate fuel delivery and maintain fuel line pressure. In particular, check valve 104 includes a ball and spring mechanism that seats and seals at a specified pressure differential to deliver fuel downstream. In some embodiments, fuel delivery system 100 may include a series of check valves fluidly coupled to fuel pump 102 to further impede fuel from leaking back upstream of the valves. Check valve 104 is fluidly coupled to filter 106. Filter 106 may remove small impurities that may be contained in the fuel that could potentially damage vital engine components. Fuel may be delivered from filter 106 to fuel pressure regulator 110 via fuel line 130. In some embodiments, a two-pump system may deliver fuel to fuel pressure regulator 110. In particular, a single fuel pump may not have the capability to pump fuel at a desired operational pressure. Thus, the two-pump system may include a low pressure pump (or lift pump) to initially pump fuel out of the fuel tank and into the fuel line. Further, fuel may flow through a high-pressure pump to increase the fuel pressure to the operational pressure or injection pressure.

Fuel pressure regulator 110 may regulate pressure of an amount of fuel in downstream in 132 and fuel rail 114. In particular, fuel pressure regulator 110 may be adjusted to vary a set-point at which fuel pressure is regulated based upon operating conditions of the engine. For example, during an engine cold start condition the fuel pressure set-point may be increased to facilitate in-cylinder-air-fuel mixing for more complete combustion which may create heat used to warm emission control device(s) to a light-off temperature. Excess fuel beyond what is used to maintain the fuel pressure at the set-point may be returned by fuel pressure regulator 110 to fuel tank 108 via return fuel line 134. Fuel pressure regulator 110 will be discussed in further detail below with reference to FIG. 2.

Alternatively, in some embodiments, the fuel delivery system may include a fuel pressure regulator that regulates fuel pressure at set-point that has limited or no adjustability. Thus, to temporarily increase the fuel pressure, pressure delay device 112 may be fluidly coupled downstream of fuel pressure regulator 110. Pressure delay device 112 may provide temporary fuel flow restriction which may increase fuel pressure during low flow conditions downstream in fuel line 134 and/or fuel rail 114, such as at engine startup. Further, pressure delay device 112 may be adapted to remove the flow restriction as the rate of fuel flowing through the pressure delay device increases so that pressure delay device 112 does not generate excess fuel pressure increases during standard vehicle operation (e.g. after engine startup). Pressure delay device will be discussed in further detail below with reference to FIG. 3.

It will be appreciated that, in some embodiments, the fuel delivery system may include one or more additional fuel pumps pressure regulator(s), check valve(s), and/or return line(s) to further regulate and/or adjust fuel pressure.

Fuel rail 114 may distribute fuel regulated at a set-point fuel pressure by fuel pressure regulator 110 (or in some embodiments pressure delay device 112) to each of a plurality of fuel injectors 116. Each the plurality of fuel injector 116 may be positioned in a corresponding cylinder 118 of engine 120 such that during operation of fuel injectors 116 fuel is injected directly into each corresponding cylinder 118. Alternatively (or in addition), engine 120 may include fuel injectors positioned at the intake port of each cylinder such that during operation of the fuel injectors fuel is injected in to the intake port of each cylinder. In, the illustrated embodiment, engine 120 includes four cylinders. However, it will be appreciated that the engine may include a different number of cylinders.

Controller 122 may receive various signals from sensors coupled to fuel delivery system 100 and engine 120. For example, controller 122 may receive a fuel pressure (and/or temperature) signal from fuel sensor 124 which may be positioned downstream of fuel pressure regulator (e.g. positioned in fuel line 132). In some cases, fuel pressure measured by fuel sensor 124 may be indicative of fuel rail pressure. In some embodiments, a fuel sensor may be positioned upstream from fuel pressure regulator 110 to measure a pressure of fuel exiting fuel pump 12. Further, controller 122 may receive engine/exhaust parameter signals from engine sensor(s) 126. For example, these signals may include measurement of inducted mass air flow, engine coolant temperature, engine speed, throttle position, and absolute manifold pressure, emission control device temperature, etc. Note that various combinations of the above measurements as well as measurements of other related parameters may be sensed by sensor(s) 126. Further, as another example, controller 122 may receive an engine start indication signal from start sensor 128. It will be appreciated that the controller may receive other signals indicative of vehicle operating.

Controller 122 may provide feedback control based on signals received from fuel sensor 124, engine sensor(s) 126, and/or start sensor 128, among others. For example, controller 122 may send signals to adjust an operation speed of fuel pump 102, a fuel pressure set-point of fuel pressure regulator 110, and/or a fuel injection amount and/or timing based on signals from fuel sensor 124, engine sensor(s) 126, start sensor 128, or a combination thereof.

In one example controller 122 is a microcomputer that includes a microprocessor unit, input/output ports, an electronic storage medium for executable programs and calibration values such as read only memory, random access memory, keep alive memory, and a data bus. The storage medium read-only memory can be programmed with computer readable data representing instructions executable by the processor for performing the method described below as well as other variants that are anticipated but not specifically listed.

Figure 2:
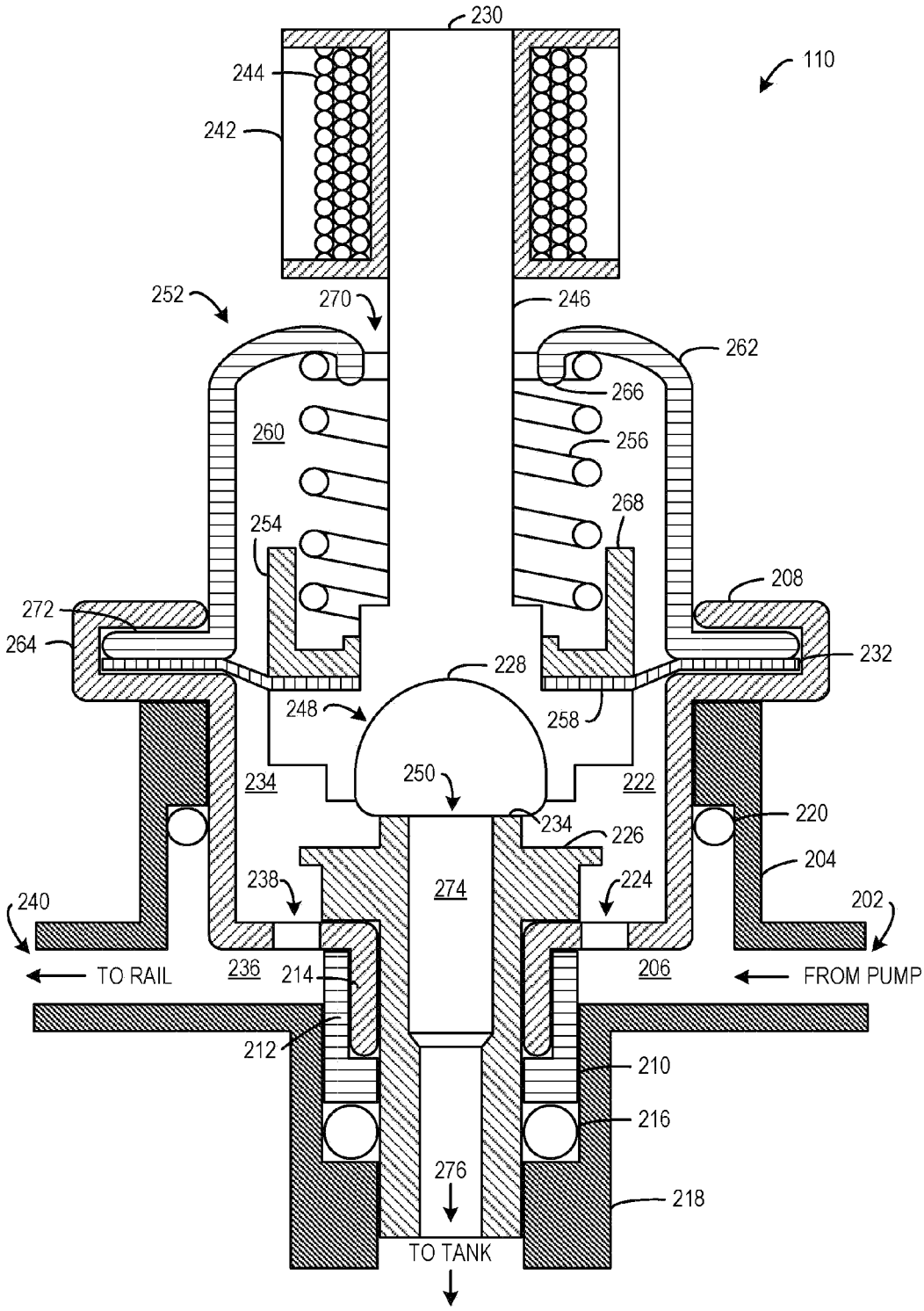
FIG. 2 shows a sectional view of an example fuel pressure regulator having a solenoid to vary a fuel pressure set-point.

FIG. 2 shows a sectional view of an example embodiment of fuel pressure regulator 110 that may be utilized in fuel delivery system 100 of FIG. 1. Fuel pressure regulator 110 may receive fuel from fuel pump 102 of FIG. 1 through inlet 202 of exterior body 204 into inlet chamber 206. Inlet chamber 206 is defined by exterior body 204, intermediate retainer 208, and seat-retainer ring 210. In particular, intermediate retainer 208 may include down-turned portion 212 that interlocks with up-turned portion 214 of seat-retainer ring 210 to form a lower portion of inlet chamber 206. Seat-retainer ring 210 may sit on lower gasket 216 that rests on sleeve 218 of exterior body 204. Lower gasket 216 may fluidly seal a lower portion of inlet chamber 206 to inhibit fuel from leaking down the interior surface of sleeve 218. Further, upper gasket 220 may fluidly seal an upper portion of inlet chamber 206 where intermediate retainer 208 and exterior body 204 meet.

Fuel may travel from inlet chamber 206 to secondary inlet chamber 222 via interior inlet passage 224 formed by intermediate retainer 208. Secondary inlet chamber 222 is defined by intermediate retainer 208, seal element 226, ground ball 228, armature 230, and diaphragm 232. Fuel may travel from interior inlet chamber 222 to interior outlet chamber 234 through a channel created between seat 234 of seal element 226 and ground ball 228 when ground ball 228 is lifted from seat 234 based on actuation of armature 230. Like secondary inlet chamber 222, secondary outlet chamber 234 is defined by intermediate retainer 208, seal element 226, ground ball 228, armature 230, and diaphragm 232. Fuel may flow from secondary outlet chamber 234 to outlet chamber 236 via interior outlet passage 238 formed by intermediate retainer 208. Like inlet chamber 206, outlet chamber 236 is defined by exterior body 204, intermediate retainer 208, and seat-retainer ring 210. Fuel may exit fuel pressure regulator 110 via outlet 240 to fuel rail 114 of FIG. 1.

Fuel pressure regulator 110 may be configured to regulate fuel pressure at a pressure set-point that may be varied according to electronic control based upon vehicle operating parameters. In particular, fuel pressure regulator 110 includes solenoid 242 having inductive coils 244 wound around a top region of shaft 246 of armature 230. Solenoid 242 may be electronically coupled to controller 122 of FIG. 1 and may receive control signals that change the state of solenoid 242. The change in the state of solenoid 242 may be a change in inductance of coils 244 which may cause a proportional force to be applied to shaft 246 to change the position and/or force of armature 230. For example, the solenoid may be oriented such that an increase in induction may cause a force to be applied to the shaft that causes the top region of the shaft to move through the solenoid so that the bottom region of the armature is positioned closer to the solenoid.

Armature 230 longitudinally spans a portion of the interior of fuel pressure regulator 110 to operatively couple to ground ball 228. In particular, armature 230 includes concave portion 248 shaped to substantially encompass ground ball 228 to maintain ground ball 228 resting on seal element 226. Ground ball 228 includes a flat base portion 250 that sits flush on seat 234 of seal element 226 to inhibit fuel from passing directly through fuel pressure regulator 110. Armature 230 may be biased to apply force on ground ball 228 by spring assembly 252

Spring assembly 252 includes diaphragm 232, spring retainer ring 254, and helical spring 256 collectively stacked on brim 258 of armature 230. Spring assembly 252 is enclosed in spring chamber 260 which is cooperatively defined by cap 262 and diaphragm 232. Diaphragm 232 is shaped to form an axially positioned circular hole having a circumference slightly larger than shaft 246 so that diaphragm 232 surrounds shaft 246. Diaphragm 232 is positioned on and supported by brim 258. Diaphragm 232 extends radially outward from brim 258 at an acute angle relative to the lateral axis of diaphragm 232 and is received in bend portion 264 of intermediate retainer 208. Diaphragm 232 may be flexible to accommodate longitudinal movement of armature 230 upon excitation of solenoid 242. Further, diaphragm 232 may fluidly seal spring chamber 260 from secondary inlet chamber 222 and secondary outlet chamber 234 so that fuel does not enter spring chamber 260.

Spring-retainer ring 254 is stacked upon diaphragm 232. Spring-retainer ring 254 is shaped to form a similarly sized central hole to that of diaphragm 232 so that spring-retainer ring 254 surrounds shaft 246. Helical spring 256 is stacked upon spring-retainer ring 254 and wrapped around shaft 246. Helical spring 256 extends along shaft 246 from spring-retainer ring 254 to cap 262. Cap 262 includes arcuate rib 266 positioned above helical spring 256 and extends downward inside the windings of helical spring 256. Spring-retainer ring 254 includes circumferentially continuous peripheral rib 268 that extends upward to surround some windings of helical spring 256. Arcuate rib 266 and peripheral rib 268 cooperatively maintain helical spring 256 longitudinally aligned with shaft 246 such that upon compression/extension helical spring 256 may be inhibited from lateral or pivotal movement within spring chamber 260.

Cap 262 forms an exterior orifice 270 through which shaft 246 extends to solenoid 242. Cap 262 is bell-shaped and has a diameter that is substantially the same size as the diameter of a middle region of intermediate retainer 208 so that cap and intermediate retainer 208 are longitudinally aligned. Cap 262 includes flange 272 that is stacked upon an edge region of diaphragm 232. Flange 272 and diaphragm 232 are surrounded by bend portion 264 of intermediate retainer 208 to retain diaphragm 232 and cap 262 in place.

Helical spring 256 may be adapted to exert spring force on cap 262 and brim 258 of armature 230 via spring-retainer ring 254 and diaphragm 232 that is further exerted on ground ball 228 to maintain ground ball 228 flush on seal element 226 to inhibit fuel from flowing directly through fuel pressure regulator 110. As discussed above, a change in induction of coils 244 of solenoid 242 may cause a proportional force to be applied to shaft 246 of armature 230. In some cases, the force applied to shaft 246 may be great enough to overcome the spring force exerted by helical spring 256 so that helical spring 256 compresses and armature 230 moves toward solenoid 242. Upon movement of armature 230 ground ball 228 may be lifted from seat 234 and fuel may flow through a channel created between ground ball 228 and seal element 226. The size of the channel may be precisely adjusted by electronically adjusting the state of solenoid 242 to restrict fuel flow through the channel and, in turn, control the pressure set-point of fuel downstream of fuel pressure regulator 110.

Furthermore, excess fuel beyond what is used to maintain fuel flow through outlet 240 at the fuel pressure set-point may be forced to flow down return passage 274 of seal element 226. Return passage 274 may be internal to seal element 226 and may be tapered and cylindrical in shape. Return passage may form a return outlet 276 through which excess fuel may be returned to fuel tank 108 of FIG. 1.

By integrating solenoid 242 into fuel pressure regulator 110, solenoid 242 may be precisely controlled so that force applied to seal element 226 may be varied on demand, thereby allowing the system to temporarily adjust the set pressure to a desired value to meet engine operating conditions.

As discussed above, in a GDI engine it may be desirable to temporarily increase fuel pressure at engine startup. In some embodiments, the fuel delivery system may include a fuel pressure regulator that regulates fuel pressure at set-point that has limited or no adjustability. Thus, in order to temporarily increase the fuel pressure provided to the fuel injectors beyond a standard operating pressure, pressure delay device 112 may be utilized to temporarily increase fuel pressure at startup as well as during other low flow conditions.

Figure 3:
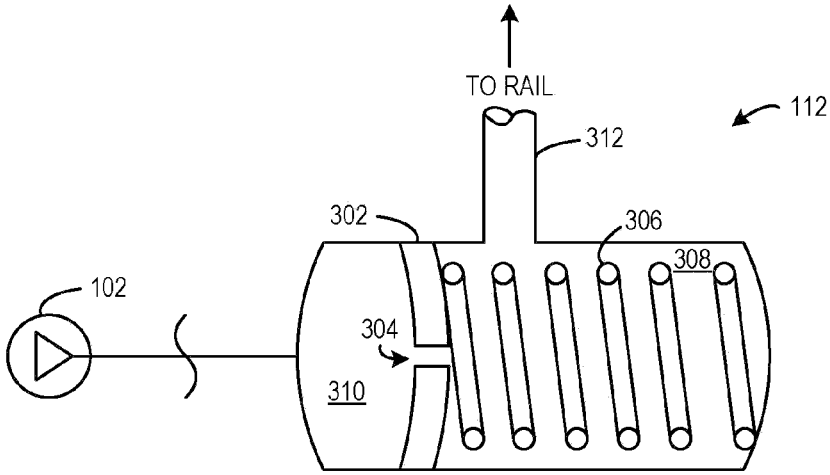
FIG. 3 shows a sectional view of an example fuel pressure delay device.

FIG. 3 shows a sectional view of an example embodiment of pressure delay device 112 that may be utilized in fuel delivery system 100 of FIG. 1. Pressure delay device 112 may be operatively coupled downstream of fuel pump 102. Pressure delay device 112 includes piston 302 having flow restriction passage 304. Spring 306 located in high-side chamber 308 may act on piston 302 and on an opposing wall of high-side chamber 308 to provide resistance to fuel entering into low-side chamber 310 of pressure delay device 112. Fuel may flow from low-side chamber 310 through restriction passage 304 into high-side chamber 308 to generate a fuel pressure increase. Further, fuel may exit pressure delay device 112 via outlet port 312 positioned in a sidewall of pressure delay device 110 upon which fuel may flow to fuel rail 114 of FIG. 1 for injection.

Furthermore, as the flow rate of fuel flowing through pressure delay device 112 increases, pressure may build in low-side chamber 310 which acts upon piston 302. Eventually, the low-side chamber pressure may become great enough to overcome spring force generated by spring 306. As such, spring 306 may compress and piston 302 may travel in the direction of high-side chamber 308. Once piston 302 travels past outlet port 312 fuel may flow directly from low-side chamber 310 to outlet port 312 without a substantial change in pressure. Piston 302 may remain compressed based on the fuel flow rate generating enough pressure to overcome the spring force of spring 306. Thus, the pressure of fuel provided to the fuel rail can be switched from the higher value to the lower value desired during standard vehicle operation (e.g. after engine startup). It will be appreciated that the pressure delay device may be adapted to output virtually any suitable fuel pressure for a duration based upon the dimensions of the flow restriction passage, low-side chamber, and high-side chamber, as well as the spring force characteristics of the spring actuated piston, and the placement of the outlet port in the sidewall of the pressure delay device.

Figure 4:
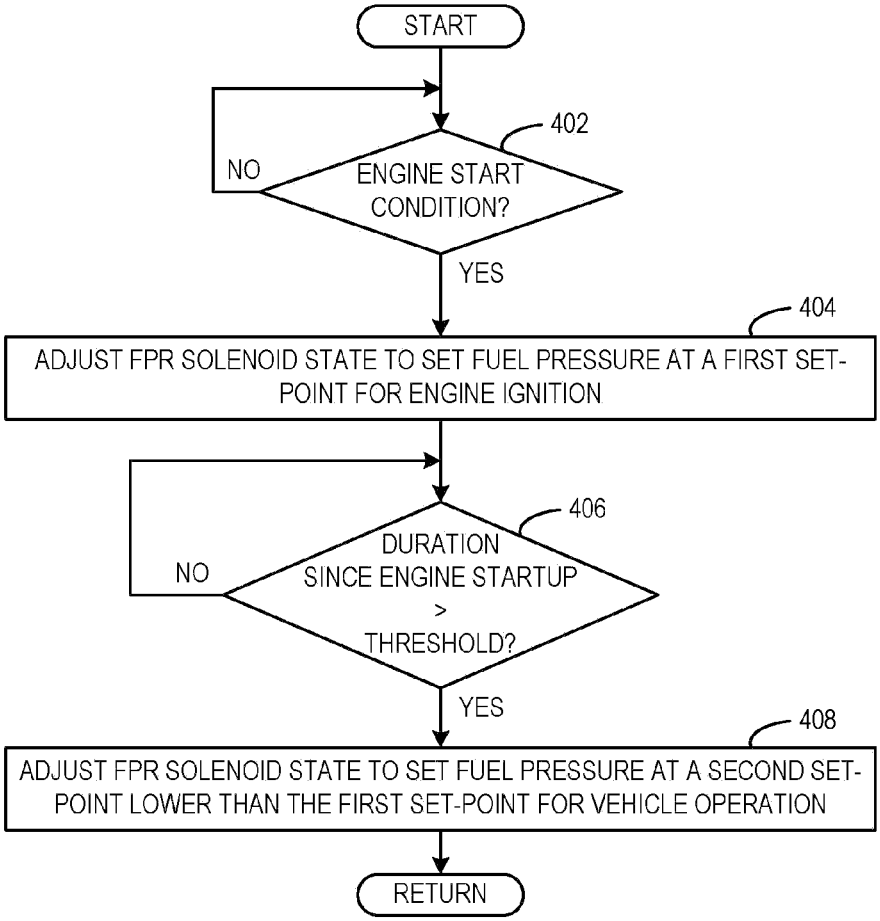
FIG. 4 shows a flow diagram of an example method for operating the fuel delivery system to temporarily provide increased fuel pressure at engine startup.

FIG. 4 shows a flow diagram of an example method for operating the fuel delivery system to temporarily provide increased fuel pressure at engine startup. Method 400 begins at 402, where the method may include determining if there is an indication of an engine start condition. The engine start condition may initiate engine cranking and ignition for combustion. In one example, the indication of engine startup is a key-on signal received from start sensor 128 of FIG. 1 in response to a vehicle operator placing a key in an ignition switch and turning the key to place the ignition switch in the key-on state. If it is determined that an engine startup condition exists, and the method moves to 404. Otherwise, it is determined that an engine startup condition does not exist and the method returns to 402, and continues to poll for an engine startup condition.

At 404, the method may include adjusting a state of a solenoid of the fuel pressure regulator to set the fuel pressure at a first set-point for engine ignition. The first set-point may be a high fuel pressure (e.g. 80-100 psi) which may facilitate combustion and/or exhaust warm-up. In one example, as shown in FIG. 2, the state of solenoid 242 may be adjusted by increasing the induction of coils 244 of solenoid 242 via a control signal from controller 122 of FIG. 1. The change in induction may cause armature 230 to move toward solenoid 242 to change the position and/or pressure of ground ball 228 relative to seal element 226 to increase the pressure of fuel output of fuel pressure regulator 112.

At 406, the method may include determining if a duration since startup of the engine has exceeded a predetermined threshold. The predetermined threshold may be a duration for engine combustion to stabilize and/or exhaust system to warm-up. In some cases, the predetermined threshold may be measured in units of time. Alternatively, the predetermined threshold may be measured in combustion cycles. In some cases, a different unit of measurement may be used. If it is determined that the duration exceeds the predetermined threshold, and the method moves to 408. Otherwise, it is determined that the duration does not exceed the predetermined threshold, and the method returns to 406 and continues to polls for the duration to exceed the predetermined threshold.

At 408, the method may include adjusting a state of the solenoid of the fuel pressure regulator to set the fuel pressure at a second-set-point that is lower than the first set-point for vehicle operation after startup conditions have stabilized. In one example, as shown in FIG. 2, the state of solenoid 242 may be adjusted by decreasing the induction of coils 244 of solenoid 242 via a control signal from controller 122 of FIG. 2. The change in induction may cause armature 230 to move away from solenoid 242 to change the position and/or pressure of ground ball 228 relative to seal element 226 to decrease the pressure of fuel output of fuel pressure regulator 112. In some cases, the second pressure set-point may be the fuel pump pressure (e.g., high pressure pump) so that the fuel pressure regulator does not increase fuel pressure between the fuel pump and the fuel rail during vehicle operation after startup.

By adjusting the state of the fuel pressure regulator solenoid based upon engine operating conditions, the fuel pressure set-point may be precisely regulated across a range of different engine operating conditions. Moreover, the precise fuel pressure set-point control may enable a lower pressure fuel pump to be used to deliver fuel during standard vehicle operation so that a fuel line backpressure does not build in the fuel delivery system that wears on fuel system components while still handling fuel pressure requirements for engine startup.

Note that the example control and estimation routines included herein can be used with various system configurations. The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein. For example, a fuel system may include multiple fuel pumps, an electronically-controlled fuel pressure regulator having a variable fuel pressure set-point coupled downstream of at least one of the fuel pumps, and a pressure delay device coupled downstream of the fuel pressure regulator.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel pressure regulator comprising:

a body forming an inlet and an outlet;

a seal element positioned intermediate the inlet and the outlet, the seal element including a return passage through which excess fuel flows when a pressure of fuel flowing through the outlet substantially is at a regulated fuel pressure set-point, an armature positioned to apply force to the seal element;

a ground ball positioned intermediate the armature and the seal element, the ground ball including a flat portion that sits flush on the seal element, the ground ball blocking flow to both the outlet and the return passage when positioned flush against the seal element; and a solenoid coiled around the armature, with excitation of the solenoid causing a change in at least one of a position of the armature relative to the seal element and a force applied by the armature to the seal element to vary the regulated fuel pressure set-point at which fuel flows through the outlet.

2. The fuel pressure regulator of claim 1, wherein the return passage is oriented perpendicular to the inlet and the outlet.

3. The fuel pressure regulator of claim 1, wherein the armature includes a concave portion sized to substantially surround the ground ball such that the armature applies force to seal element via the ground ball to regulate the pressure of fuel flowing through the outlet at the set-point.

4. The fuel pressure regulator of claim 3, further comprising a spring to apply a spring force to the armature to bias the armature, and wherein excitation of the solenoid creates a force large enough to overcome the spring force.

5. The fuel pressure regulator of claim 4, wherein the spring is a helical spring wrapped around a shaft of the armature.

6. The fuel pressure regulator of claim 4, wherein the armature is biased against the ground ball to hold the ground ball flush against the seal element.

7. The fuel pressure regulator of claim 4, wherein the spring is fluidly sealed from the inlet and the outlet by a diaphragm.

8. The fuel pressure regulator of claim 7, wherein the diaphragm forms a central hole and the diaphragm is positioned such that a shaft of armature extends through the central hole.

9. The fuel pressure regulator of claim 7, further comprising:

an intermediate retainer forming a secondary inlet passage and a secondary outlet passage;

a secondary inlet chamber formed by the intermediate retainer, the seal element, the armature, and the diaphragm;

a secondary outlet chamber formed by the intermediate retainer, the seal element, the armature, and the diaphragm; and where the path of fuel flowing from the inlet to the outlet includes flowing from the inlet, through the secondary inlet passage into the secondary inlet chamber, between the seal element and the ground ball into the secondary outlet chamber, through the secondary outlet passage and out of the outlet.

10. The fuel pressure regulator of claim 1, wherein the armature is aligned with a longitudinal axis of the fuel pressure regulator.

11. The fuel pressure regulator of claim 1, wherein the armature is positioned perpendicular to a top surface of the seal element.

12. A method for operating a fuel system of a vehicle during startup utilizing gasoline direct injection for an internal combustion engine, the fuel system including at least one fuel pump, a fuel pressure regulator fluidly coupled to the at least one fuel pump, the fuel pressure regulator having an electronically-controlled solenoid to vary a fuel pressure set-point of fuel flowing from an outlet of the fuel pressure regulator, a fuel rail fluidly coupled downstream of the outlet to supply fuel to direct fuel injectors coupled to the engine, the method comprising:

generating a flow of fuel in the fuel system via actuation of the at least one fuel pump during an engine start, before ignition of the engine;

adjusting a state of the solenoid to regulate fuel downstream of the fuel pressure regulator at a first pressure set-point;

injecting fuel at the first pressure set-point via the direct fuel injectors for combustion during a duration before startup conditions have stabilized;

after startup conditions have stabilized, adjusting the state of the solenoid to regulate fuel downstream of the fuel pressure regulator at a second pressure set-point lower than the first pressure set-point; and injecting fuel at the second pressure set-point via the direct fuel injectors for combustion.

13. The method of claim 12, wherein conditions are stabilized after a predetermined duration.

14. The method of claim 13, wherein the predetermined duration is a predetermined number of combustion cycles.

15. The method of claim 12, wherein the start threshold is a light-off temperature of an emissions control device.

16. The method of claim 12, wherein the second pressure set-point is a pressure output by the at least one fuel pump.

17. A fuel delivery system for a vehicle comprising:

a fuel tank;

at least one fuel pump to pump liquid fuel from the fuel tank;

a fuel pressure regulator fluidly coupled downstream of the at least one fuel pump to regulate a pressure of fuel flowing out of the fuel pressure regulator at a first set-point, the fuel pressure regulator including:

a body forming an inlet and an outlet;

a seal element positioned intermediate the inlet and the outlet;

an armature positioned to apply force to the seal element, the seal element including a return passage through which excess fuel flows when a pressure of fuel flowing through the outlet substantially is at the first set-point;

a ground ball positioned intermediate the armature and the seal element, the ground ball including a flat portion that sits flush on the seal element, the ground ball blocking flow to both the outlet and the return passage when flush against the seal element;

a fuel pressure delay device fluidly coupled downstream of the fuel pressure regulator, the fuel pressure delay device including:

a body forming an inlet and an outlet;

a piston positioned within the body, the piston forming a flow restriction passage to increase a pressure of fuel flowing out of the flow restriction passage to a second set-point higher than the first set-point;

a spring positioned within the body to bias the piston to be positioned between the inlet and the outlet; and upon the flow rate of fuel entering the inlet being greater than the spring force applied to the piston by the spring, the piston being adapted to moving against the spring so that fuel enters the inlet flows through the outlet at the first set-point pressure.

18. The system of claim 17, wherein the outlet is positioned in a sidewall of the body.

* * * * *